US009890545B1

(12) United States Patent
Bongiorno

(10) Patent No.: US 9,890,545 B1
(45) Date of Patent: Feb. 13, 2018

(54) ERECTION SYSTEM

(71) Applicant: Steven James Bongiorno, Freeport, NY (US)

(72) Inventor: Steven James Bongiorno, Freeport, NY (US)

( * ) Notice: Subject to any disclaimer, the term of this patent is extended or adjusted under 35 U.S.C. 154(b) by 0 days.

(21) Appl. No.: 15/350,992

(22) Filed: Nov. 14, 2016

(51) Int. Cl.

| | |
|---|---|
| ***E04G 21/16*** | (2006.01) |
| ***E04B 1/18*** | (2006.01) |
| ***E04C 5/06*** | (2006.01) |
| ***B66C 1/10*** | (2006.01) |
| ***B66C 1/62*** | (2006.01) |
| ***E04C 5/16*** | (2006.01) |

(52) U.S. Cl.
CPC ..... *E04G 21/16* (2013.01); *B66C 1/10* (2013.01); *B66C 1/62* (2013.01); *E04B 1/18* (2013.01); *E04C 5/0604* (2013.01); *E04C 5/0618* (2013.01); *E04C 5/0622* (2013.01); *E04C 5/16* (2013.01)

(58) Field of Classification Search
CPC ..... E04C 5/0604; E04C 5/0618; E04C 5/163; E04C 5/16; E04C 5/18; E04C 5/208; E04C 5/0622; B66C 1/10; B66C 1/62; B66C 1/66; B66C 1/666
USPC ..... 52/122.1, 123.1, 125.1, 125.2, 125.3, 52/125.6, 126.1, 126.3, 126.4, 126.7, 52/745.02, 745.03, 745.04, 745.17, 745.2, 52/649.1, 649.3, 849, 844, 845; 414/626; 294/67.1, 67.3
See application file for complete search history.

(56) References Cited

U.S. PATENT DOCUMENTS

| | | | | | |
|---|---|---|---|---|---|
| 2,998,994 | A * | 9/1961 | Karr | B66C 1/127 | 294/67.1 |
| 3,103,709 | A * | 9/1963 | Bolt | E04B 1/343 | 52/125.2 |
| 3,473,285 | A * | 10/1969 | Reiland | E04C 5/163 | 52/295 |
| 3,800,493 | A * | 4/1974 | Livingston | E04B 1/34869 | 52/125.6 |
| 4,467,583 | A | 8/1984 | Hasak | | |
| 4,671,724 | A * | 6/1987 | Bolton | B65G 59/063 | 221/283 |

(Continued)

*Primary Examiner* — Robert Canfield
*Assistant Examiner* — Matthew J Gitlin
(74) *Attorney, Agent, or Firm* — Alfred M. Walker

(57) ABSTRACT

An erection system for one or more elongated elements, such as structural columns, pre-fabricated reinforcing cages or tower-like structures includes one or more longitudinal lifting bars running parallel with the elongated element's longitudinal direction. The lifting bars are installed within or onto the elongated element through apertures in the element's upper and lower support pieces. A rigging system supports the upper portion of the lifting bar. The lifting bar's lower portion includes external threading to receive an internally threaded load bearing nut. The load bearing nut supports the elongated element's weight onto the lifting bar's lower portion. The upper and lower support pieces stabilize the elongated element with lateral restraint. Removing the load bearing nut and raising the lifting bar up through the support piece's apertures extracts the lifting bar from the elongated element. Adjustable spreader bars separate multiple lifting bars to minimize lateral and bending stresses in the lifting bar.

28 Claims, 14 Drawing Sheets

(56) References Cited

U.S. PATENT DOCUMENTS 4,807,407 A * 2/1989 Horn ..... E04B 1/24 52/125.2
5,181,756 A * 1/1993 Yurick ..... B66C 1/10 294/67.1
5,181,825 A * 1/1993 Sugitani ..... B66C 1/16 187/900
5,327,690 A * 7/1994 Saito ..... E04G 21/16 52/118
5,392,580 A * 2/1995 Baumann ..... B21F 27/125 52/646
5,410,847 A * 5/1995 Okawa ..... E04B 1/30 403/346
5,528,877 A * 6/1996 Franklin ..... E04B 1/3516 264/33
5,529,360 A * 6/1996 Black ..... B66C 1/12 294/67.1
6,293,071 B1 * 9/2001 Konstantinidis ..... E04C 5/02 52/659
6,481,165 B1 * 11/2002 Romary ..... E04B 1/34336 52/122.1
6,957,838 B2 * 10/2005 Nowak ..... B66C 1/10 294/67.1
7,444,730 B1 * 11/2008 Beatty ..... B66C 1/62 211/204
7,739,843 B2 * 6/2010 Cortina-Cordero ..... E04H 12/12 416/DIG. 6
8,069,634 B2 * 12/2011 Livingston ..... F03D 13/10 52/120
8,209,913 B2 7/2012 Murata
8,375,678 B1 * 2/2013 Ferrer ..... E04C 5/165 52/414
8,381,479 B1 2/2013 Ferrer
8,533,956 B2 * 9/2013 Perry ..... E04C 5/0604 140/112
9,003,720 B2 * 4/2015 Siqueiros ..... E01C 23/10 52/125.5
9,038,348 B1 5/2015 Fang et al.
9,267,287 B1 2/2016 Bongiorno
2002/0083658 A1 * 7/2002 Dial, Jr. ..... B22C 9/24 52/125.4
2005/0183381 A1 * 8/2005 Rosenberg ..... C04B 28/02 52/649.3
2005/0257445 A1 * 11/2005 Neef ..... E04G 21/142 52/125.2
2009/0100784 A1 * 4/2009 Garza ..... E04C 5/163 52/686
2012/0279141 A1 * 11/2012 Wiederick ..... E04H 5/02 52/79.5
2013/0020818 A1 * 1/2013 Parker ..... B66C 1/10 294/81.5
2013/0205688 A1 * 8/2013 Muirhead ..... E04B 2/20 52/122.1
2015/0308096 A1 * 10/2015 Merhi ..... B66D 3/18 52/125.1

* cited by examiner

ERECTION SYSTEM

I have invented a new method and apparatus for erecting elongated elements, or assemblies of elements.

FIELD OF THE INVENTION

The present invention relates to the erection of elongated elements, or assemblies of elements, such as performed during construction, in a safe and efficient manner.

BACKGROUND OF THE INVENTION

The present invention relates to construction technologies. In particular, the present invention relates to the lifting and installation of elongated elements, or assemblies of elements, such as for example, steel columns, precast concrete columns, prefabricated reinforcing cages, and tower-like structures, to name a few. Examples of prefabricated reinforcing cages are shown in the patents Ferrer (U.S. Pat. No. 8,381,479), Hasak (U.S. Pat. No. 4,467,583) and Bongiorno (U.S. Pat. No. 9,267,287). Examples of tower-like structures are shown in the patents of Fang (U.S. Pat. No. 9,038,348) and Murata (U.S. Pat. No. 8,209,913). The present invention provides a method and apparatus for the safe, efficient and economical erection and installation of such elongated elements.

The current methods for erection of elongated, substantially vertically oriented, elements includes attaching lifting lines such as cables and slings from a lifting device such as a crane near the top of the element. This results in a condition where there is a pivot point at the top of the element, with the center of gravity of the element located below the pivot point. This results in a naturally stable condition such as a traditional pendulum. However, this also necessitates that the disconnection of the lifting lines after the element is installed at its intended location is to be made at the top of the element. In some cases, especially where the element is tall, it is difficult to access the upper portion of the element to disconnect the lifting lines. Doing so may also pose certain safety concerns.

Alternatively, others have attached the lifting lines to lower portions of elongated elements to overcome these concerns. However, this results in a condition where the pivot point is located below the center of gravity of the element. This results in a naturally unstable condition, such as the case of an inverted pendulum. See FIGS. 26A-27B for diagrammatic illustration.

It is therefore advantageous to have an erection method where the connection point of the lifting lines to an elongated, substantially vertical, element is at a lower point where the connection is safer and more easily accessible to disconnect them, while at the same time providing lateral stability to the element.

OBJECTS OF THE PRESENT INVENTION

There is a need for a safe and efficient means for the lifting and installation of elongated elements, or assemblies of elements, such as for example, steel columns, precast concrete columns, prefabricated reinforcing cages, and tower-like structures, that overcomes the limitations, shortcomings and disadvantages of the current practice. The present invention overcomes these limitations, shortcomings and disadvantages.

Other objects will become apparent from the following description of the present invention.

SUMMARY OF THE INVENTION

In keeping with these objects and others which may become apparent, the problems with the current methods of erecting elongated elements are solved in the present application by providing an elongated element with at least two support pieces spaced apart from each other. One of the at least two support pieces is preferably located at the upper portion of the element, and one of the at least two support pieces is preferably located at the lower portion of the element. Additional support pieces may optionally be placed between said upper and lower support pieces. The elongated element is further provided with at least one lifting bar that is inserted through each of the at least two support pieces and connected to said support pieces to provide the vertical and lateral stabilizing restraint for the elongated element during erection.

The lower support piece holds the vertical weight of the element while ensuring lateral restraint for stability and positioning of the lower portion or the element. See FIGS. 26A-27B for diagrammatic illustration. This lower support piece supports the vertical weight of the element by connection to a removable loadbearing piece, preferably an internally threaded loadbearing nut, located below the support piece, while allowing for free movement of the lifting bar in the longitudinal direction away from the upper support piece during installation of the lifting bar. This loadbearing piece is attached to the lifting bar which in turn supports the vertical weight axially to the lifting device. The removable loadbearing nut allows for disconnection of the lifting bar to be done at the lower portion of the element. The loadbearing nut is preferably threaded onto the lifting bar to facilitate installation and removal, and also to permit for vertical adjustment of the elevation of the support point of the lifting bar against the lower support piece.

The upper support piece provides lateral restraint to the upper portion of the element against the lifting bar, ensuring lateral stability of the element. See FIGS. 26A-27B for diagrammatic illustration. The upper support piece may optionally be provided with a stop piece, preferably a loadbearing nut or plate, located above the upper support piece to prevent undesired movement of the lifting bar toward the lower support piece, while allowing for free movement of the lifting bar in the longitudinal direction away from the lower support piece during extraction of the lifting bar.

The support pieces are preferably comprised of steel brackets or loadbearing frames preferably made of axially extending members preferably made of steel. The support pieces are provided with at least one aperture for receiving the at least one lifting bar. The size of the aperture being complimentary to the size of the lifting bar and being large enough to allow free movement of the lifting bar through it, while being small enough that to provide adequate lateral restraint described previously. Where the apertures are larger than desired to achieve this, the annular space between the lifting bar and the aperture can be reduced with the use of a bushing or makeup sleeve.

Examples of loadbearing frames used with elongated elements are shown in the patents of Ferrer (U.S. Pat. No. 8,381,479), Hasak (U.S. Pat. No. 4,467,583) and Bongiorno (U.S. Pat. No. 9,267,287). The loadbearing frames of Ferrer '479 are comprised of horizontally oriented steel plates, or "templates", with apertures for a plurality of longitudinally extending bars. The templates of Ferrer '479 may be adapted for use as the support pieces of the present invention by adapting the apertures to accept the lifting bar of the present invention. Additionally, the templates of Ferrer '479 may be reinforced or supplemented with additional loadbearing frames.

The loadbearing frames of Bongiorno '287 and Hasak '583, are comprised of axially extending, or circumferentially extending, vertically oriented, plates, with various holding means for a plurality of longitudinally extending bars. The loadbearing frames of Bongiorno '287 and Hasak '583 may be adapted for use as the support pieces of the present invention by attaching axially extending sleeves to receive the lifting bar of the present invention. Alternatively, brackets can be attached to the frame plates by welding or by fasteners. The brackets are provided with apertures for receiving the lifting bar of the present invention. Alternatively, additional frame plates can be added and arranged to form apertures for the lifting bars.

Where the elongated element is comprised of a framework, such as a lattice or trussed tower-like structure, the support pieces of the present invention, acting as independent loadbearing support frames, are preferably attached to the elongated element with fasteners or by welding.

Where the elongated element is comprised of a solid or continuous type structure, such as a structural steel column or precast concrete column, the support pieces of the present invention are preferably comprised of brackets that are preferably attached to the elements by welding or by fasteners. The brackets are preferably made of steel and provided with apertures for receiving the lifting bars in the same way as the loadbearing frames described above.

The lifting bars are comprised preferably of steel bars preferably with external threading along at least a portion of its length to accept a loadbearing nut having complimentary internal threading. The loadbearing nut is preferably provided with a temporary holding means comprised preferably of a spring clamp, but alternatively may be provided with a standard set screw. The upper end of the lifting bar is provided with a preferably steel lifting collar onto which a preferably steel lifting ring, or hook eye, is attached for rigging to the lifting lines. The lifting collar is preferably located in close proximity to the top of the upper support piece to reduce the projected length of the bar between the upper support pieces and the lifting collar, thus minimizing undesirable lateral and bending stresses in the lifting bar.

Where more than on lifting bar is used, they may be provided with a spreader piece, such as an adjustable spreader bar oriented perpendicular to the longitudinal axis of the lifting bars to resist the horizontal force resulting for example from the lifting lines acting at an angle to the longitudinal axis of the lifting bars. See FIGS. 24A-25B for diagrammatic illustration. The spreader bar thus minimizes undesirable lateral and bending stress in the lifting bar and maintains lateral separation between the top portions of the lifting bars during installation and after they have been extracted.

The lifting bars may be installed within or onto the elongated elements at any time prior to the erection of the element. This may be done in a shop or at the location where the erection of the element is to be made by inserting the one or more bars through the respective apertures in the at least two support pieces to their intended position in the elongated element. The lifting bars are fastened in place to the lower support piece, preferably with a loadbearing nut, The thus installed loadbearing nut at the lower support piece and the stop piece at the upper support piece ensure that lift bars are maintained in their intended position until it is desired to remove them.

Where the elongated element is ready to be erected, a lifting device and lifting lines are be attached to the lifting collar on the at least one lifting bar and the element is hoisted to its intended position. Once the elongated element is in its intended position or else sufficiently connected to other elements, the loadbearing nut on the at least one lifting bar is removed and the at least one lifting bar is extracted from elongated element and can be reused for subsequent or future elements.

BRIEF DESCRIPTION OF THE DRAWINGS

The present invention can best be understood in connection with the accompanying drawings. It is noted that the invention is not limited to the precise embodiments shown in drawings, in which.

DRAWINGS—REFERENCE NUMERALS

Figure 1:
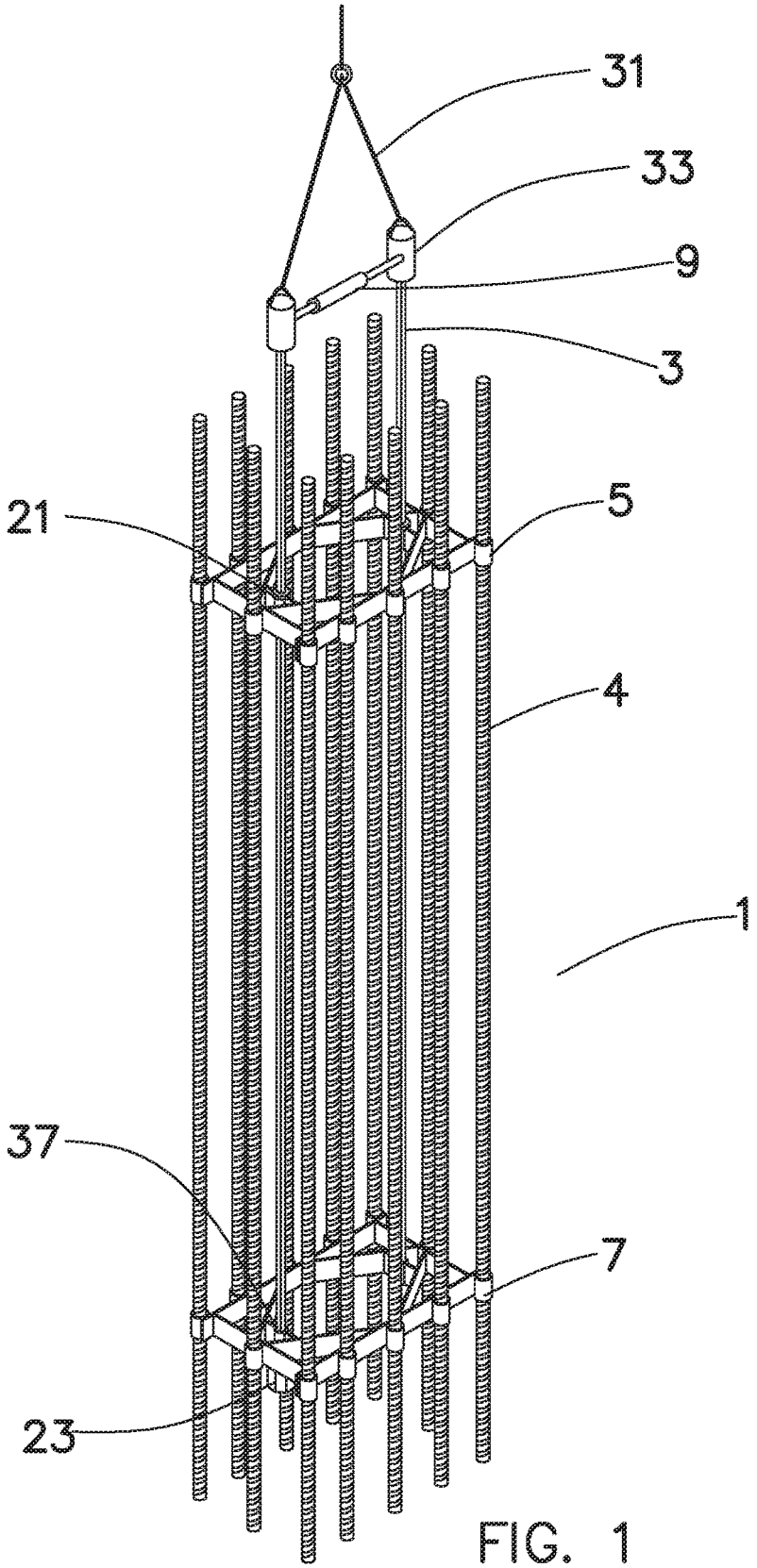
FIG. 1 is an isometric view of an elongated element comprised of a prefabricated reinforcing cage with the upper and lower support pieces and lifting bars of the present invention.
Figure 2:
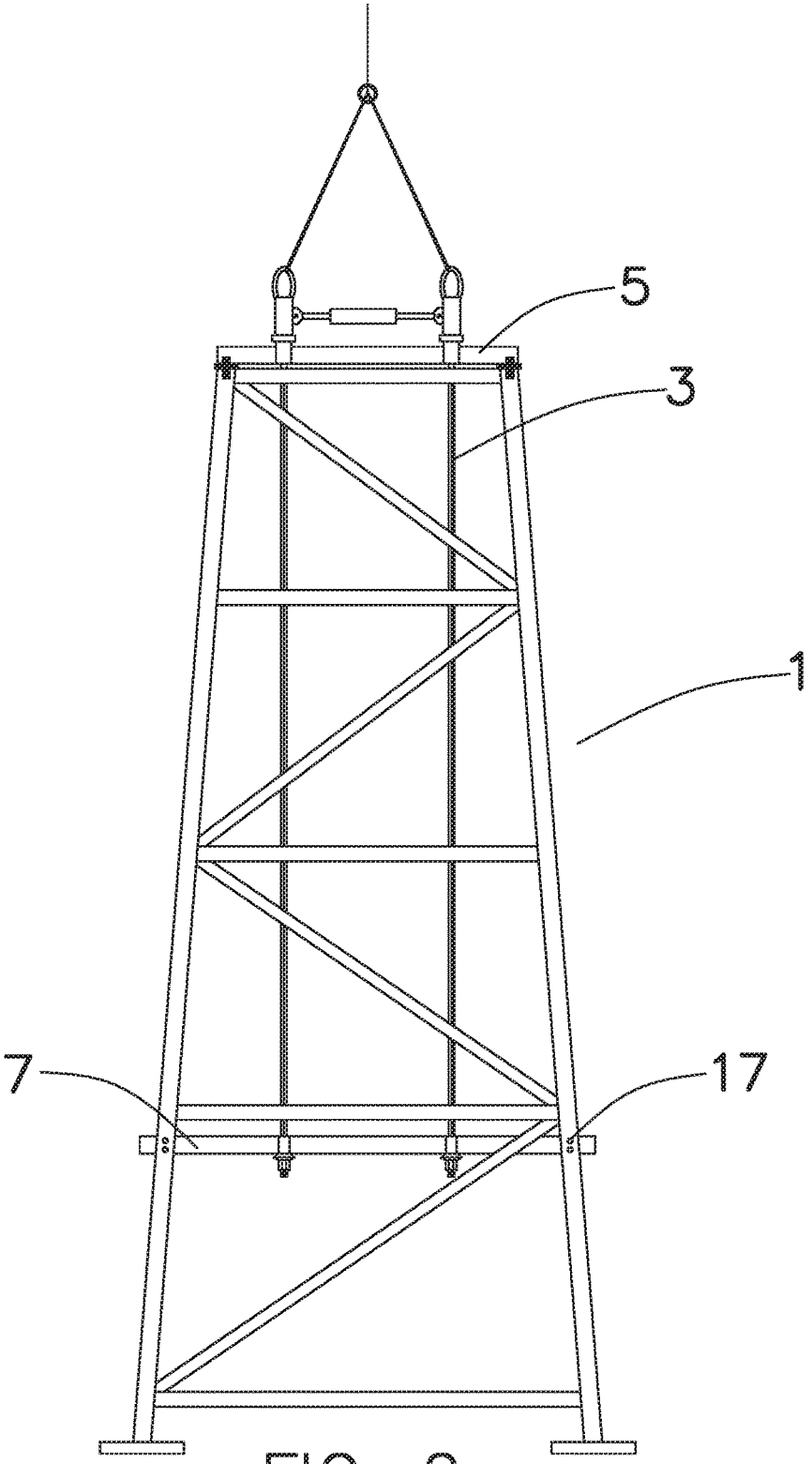
FIG. 2 is an elevational view of an elongated element comprised of a tower-like structure with the upper and lower support pieces and lifting bars of the present invention.
Figure 3A:
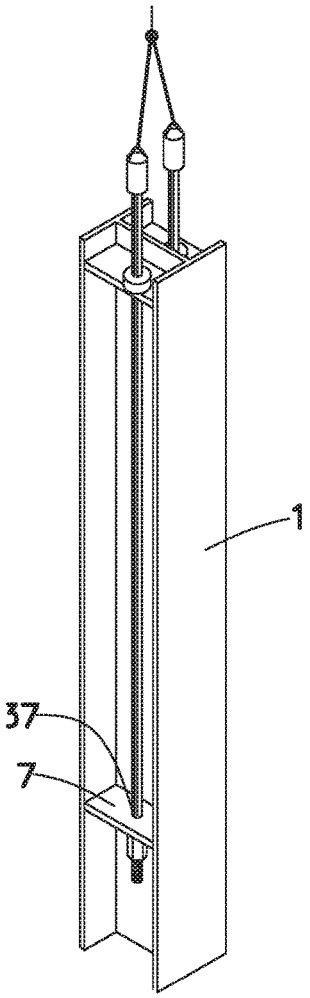
FIG. 3A is an isometric view of an elongated element comprised of a structural steel column with the upper and lower support pieces and lifting bars of the present invention.
Figure 3B:
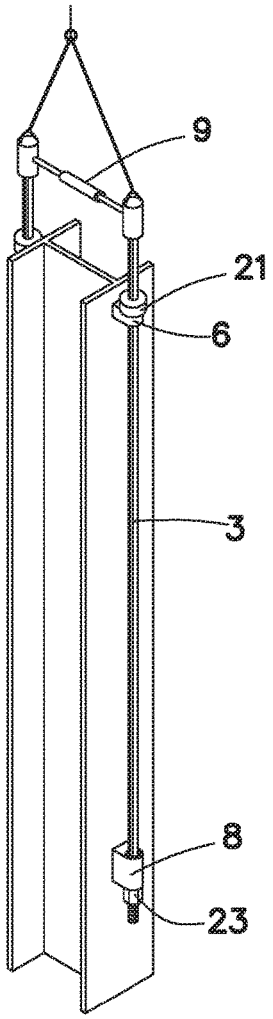
FIG. 3B is an isometric view of an elongated element comprised of a structural steel column with another embodiment of the upper and lower support pieces and lifting bars of the present invention.
Figure 3C:
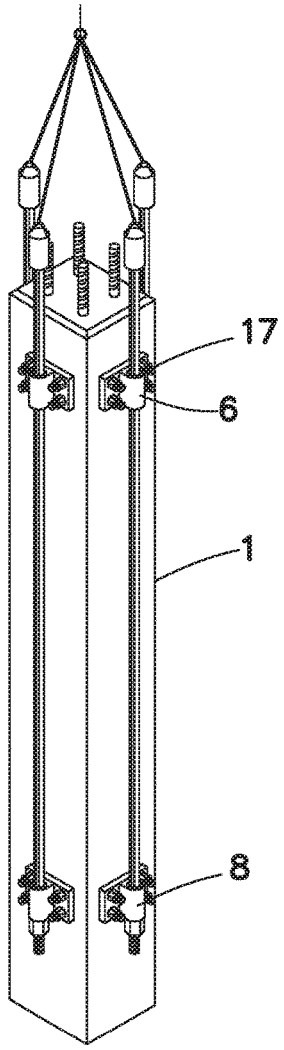
FIG. 3C is an isometric view of an elongated element comprised of a precast concrete column with the upper and lower support pieces and lifting bars of the present invention.

For illustrative purposes only, a preferred mode for carrying out the invention is described herein, wherein the following reference numerals are non-limiting examples.

1. Elongated Element
3. Lifting Bar
4. Reinforcing Bar of an Elongated Element to be Lifted
5. Upper Support Piece
6. Upper Support Piece Bracket
7. Lower Support Piece
8. Lower Support Piece Bracket
9. Spreader Bar
11. Cage frame
13. Templates
15. Sleeve for Lifting Bar
16. Sleeve for Reinforcing Bar
17. Fastener
19. Weld
21. Lifting bar stop piece
23. Lifting bar loadbearing nut
25. Internal threading
27. External threading
29. Set screw
31. Lifting Lines
33. Lifting Collar
35. Temporary holding means
37. Aperture for Lifting Bar
38. Aperture for Reinforcing Bar
39. Stiffening Frame
41. Loadbearing Frame
43. Connectors
45. Bushing
47. Lifting Device
49. Casting Material
51. Holes for Fasteners
53. Makeup Collar
54. Nut
55. Bending of Lift Bars
56. Lateral Deflection of Lift Bar
57. Weight of Element from Lower Support Piece
58. Lateral Force Resisted by Upper Support Piece
59. Lateral Force Resisted by Spreader Element
60. Representative Vertical and Lateral Restraint Point of Lower Support Piece
61. Representative Lateral Restraint Point of Upper Support Piece
62. Linear Representation of Elongated Element
63. Lumped Representation of the Weight of the Elongated Element
64. Representation of Rotational Instability

DETAILED DESCRIPTION OF THE INVENTION

The subject of the present invention will now be described, with reference to the accompanying drawings shown in FIGS. 1-23. Where similar components are shown in multiple figures, the respective description of the parts may not be repeated.

Referring to FIGS. 1-6, the elongated element (1) of the present invention is provided with at least two support pieces (5 & 7) spaced apart from each other. One of the at least two support pieces (5) is preferably located at the upper portion of the element (1), and one of the at least two support pieces (7) is preferably located at the lower portion of the element (1). Additional support pieces may optionally be placed between said upper (5) and lower (7) support pieces. The elongated element (1) is further provided with at least one lifting bar (3) that is inserted through each of the at least two support piece (5 & 7) and connected to said support piece to provide the vertical and lateral stabilizing restraint for the elongated element (1) during erection.

Referring also to FIGS. 26A-27B for diagrammatic illustration, the lower support piece (7) holds the vertical weight (63) of the element (1 and 62) while ensuring lateral restraint (60) for stability and positioning of the lower portion or the element (1 and 62). This lower support piece (7) supports the vertical weight (63) of the element (1) by bearing against a removable loadbearing piece, preferably an internally threaded loadbearing nut (23), located below the lower support piece (7), while allowing for free movement of the lifting bar (3) in the longitudinal direction away from the upper support piece (5) during installation of the lifting bar (3). The loadbearing nut (23) is attached to the lifting bar (3) which in turn supports the vertical weight axially to the lifting device (47). The removable loadbearing nut (23) allows for disconnection of the lifting bar (3) to be done at the lower portion of the element (1). The loadbearing nut (23) is preferably threaded onto the lifting bar (3) to facilitate installation and removal, and also to permit for vertical adjustment of the elevation of the support point of the lifting bar (3) against the lower support piece (7).

Referring again to FIGS. 26A-27B for diagrammatic illustration The upper support piece (5) provides lateral restraint (61) to the upper portion of the element (1) by bearing laterally against the at least one lifting bar (3), thus resisting the instability (54) of the element (62) that may potentially exist without having said lateral restraint (61) provided by said upper support piece (5).

Referring to FIGS. 7-17, the support pieces (5&7) are preferably comprised of loadbearing frames preferably made of axially extending members preferably made of steel. The support pieces (5&7) are provided with at least one aperture (37) for receiving the at least one lifting bar (3). The size of the aperture (37) being complimentary to the size of the lifting bar (3) and being large enough to allow free movement of the lifting bar (3) through it, while being small enough that to provide adequate lateral restraint described previously. Where the aperture (7) are larger than desired to achieve this, the annular space between the lifting bar (3) and the aperture (37) can be reduced with the use of a bushing (45) or makeup collar (53) comprised preferably of a steel cylindrical sleeve.

Referring to FIGS. 10-11 and 16-17, a loadbearing frame from the patent of Ferrer (U.S. Pat. No. 8,381,479) can be adapted for use used with the present invention. The loadbearing frames of Ferrer '479 are comprised of horizontally oriented steel plates, "templates (13)", with apertures (38) for a plurality of longitudinally extending bars. The templates (13) of Ferrer '479 are adapted for use as the support pieces (5 & 7) of the present invention by using at least one of the existing apertures (38) for the respective reinforcing bars (4) to accept the lifting bar (3) of the present invention, or by providing at least one additional aperture (37) for the at least one lifting bar (3) of the present invention. Additionally, the templates (13) of Ferrer '479 may be reinforced or supplemented with additional stiffening frames (39).

Figure 8:
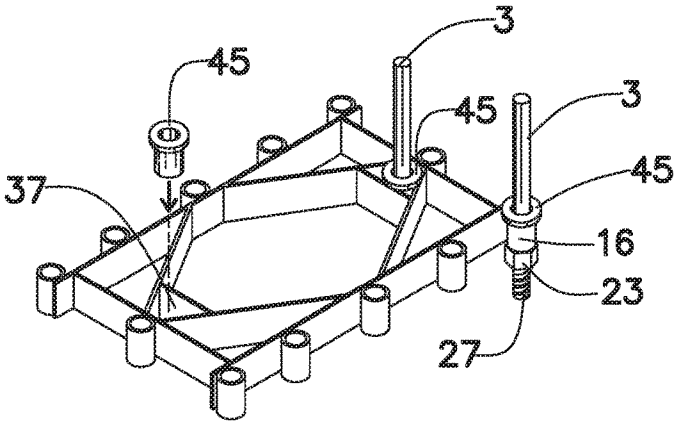
FIG. 8 is an isometric view of another embodiment of the cage frame of Bongiorno '287 adapted for use as another embodiment of the lower support piece and lifting bars of the present invention.
Figure 7:
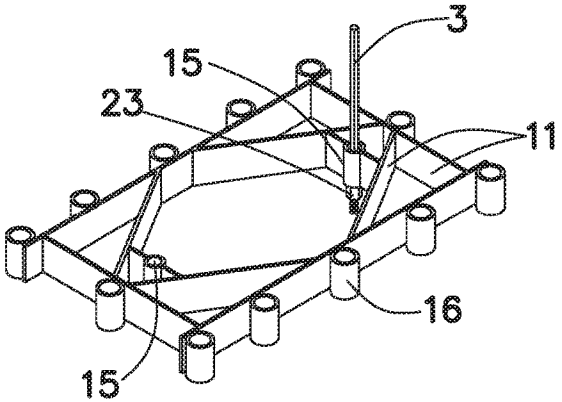
FIG. 7 is an isometric view of the cage frame of Bongiorno '287 adapted for use as the lower support piece and lifting bars of the present invention.
Figure 15:
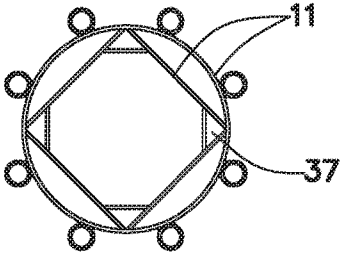
FIG. 15 is a plan view of another embodiment of the cage frame of Bongiorno '287 adapted for use as a support piece of the present invention.
Figure 16:
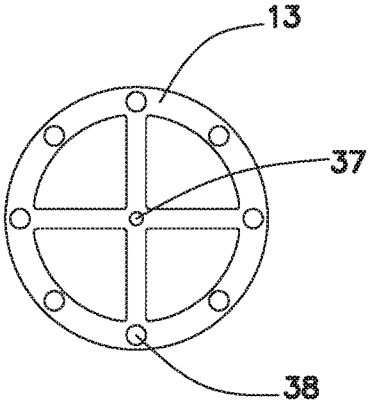
FIG. 16 is a plan view of another embodiment of the template of Ferrer '479 adapted for use as a support piece of the present invention.
Figure 17:
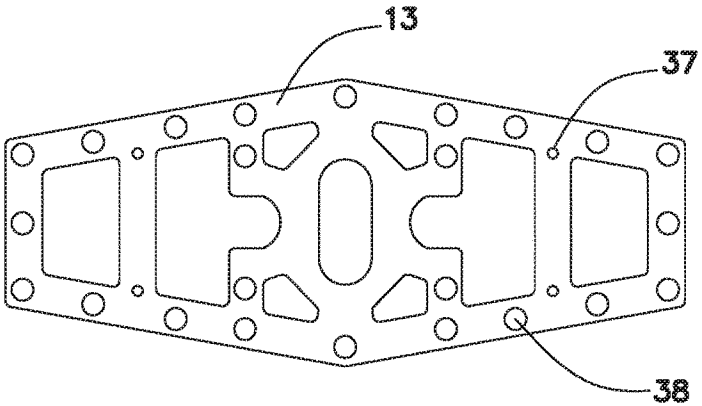
FIG. 17 is a plan view of the template of Ferrer '479 adapted for use as a support piece of the present invention.
Figure 21:
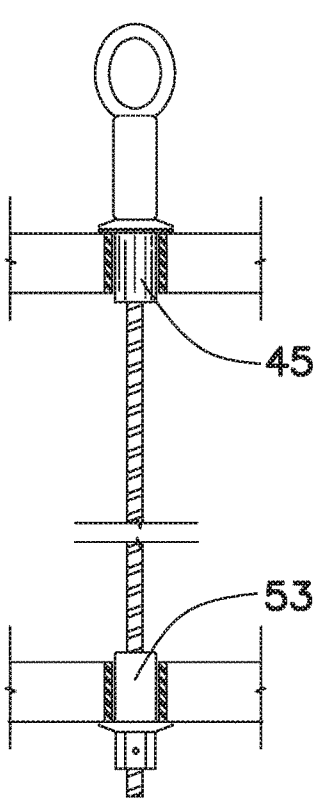
FIG. 21 is a sectional view through another embodiment of the upper and lower support pieces of the present invention at the location of another embodiment of the lifting bar of the present invention.
Figure 20:
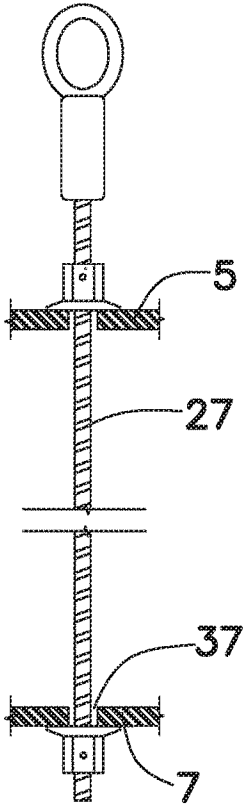
FIG. 20 is a sectional view through another embodiment of the upper and lower support pieces of the present invention at the location of another embodiment of the lifting bar of the present invention.
Figure 19:
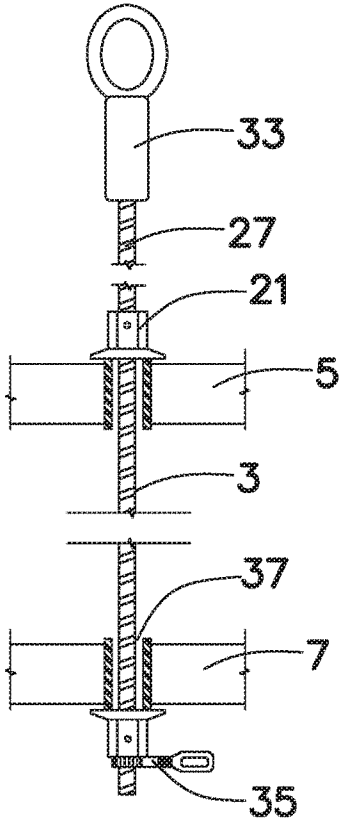
FIG. 19 is a sectional view through one embodiment of the upper and lower support pieces of the present invention at the location of another embodiment of the lifting bar of the present invention.
Figure 18:
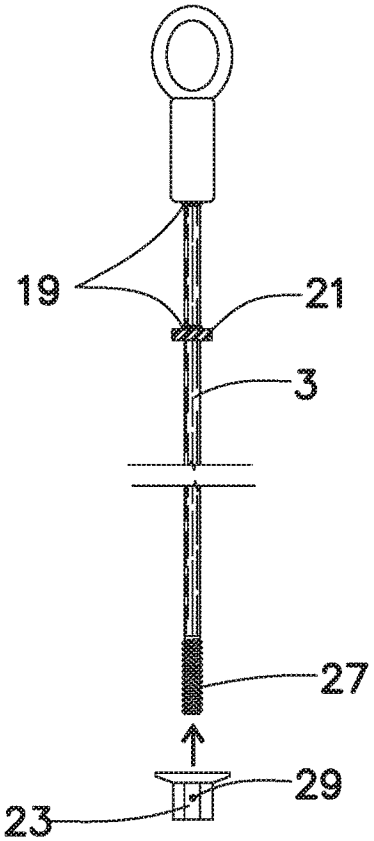
FIG. 18 is an elevation view of one embodiment of the lifting bar of the present invention.

Referring to FIGS. 7-9 and 13-15, a loadbearing frame from the patent of Bongiorno (U.S. Pat. No. 9,267,287). can be adapted for use used with the present invention. The loadbearing frames of Bongiorno '287, are comprised of axially extending, or circumferentially extending, vertically oriented, plates, with various sleeves (16) for a plurality of longitudinally extending bars. The loadbearing frames of Bongiorno '287 are adapted for use as the support pieces (5 & 7) of the present invention by using at least one of the existing sleeves (16) for the respective reinforcing bars (4) or by attaching additional axially extending sleeves (15) to receive the lifting bar (3) of the present invention. Alternatively, at least one bracket (6) is attached to the cage frame (11) by welding (19) or by fasteners (17). The at least one bracket (6) is preferably made of steel and is provided with an aperture (37) for receiving the lifting bar (3). Alternatively, additional frame plates (11) can be added and arranged to form the aperture (37) as shown in FIGS. 8 and 15.

Figure 4A:
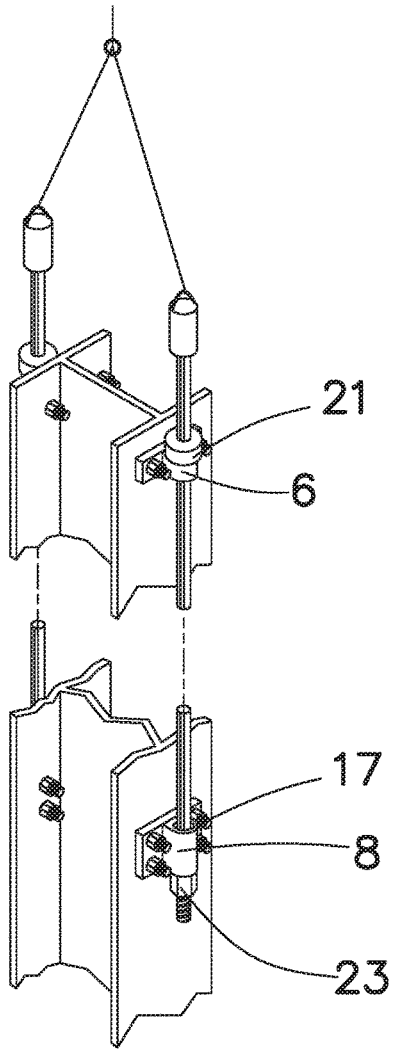
FIG. 4A is an isometric view of other embodiments of the upper and lower support pieces and lifting bars of the present invention.
Figure 4B:
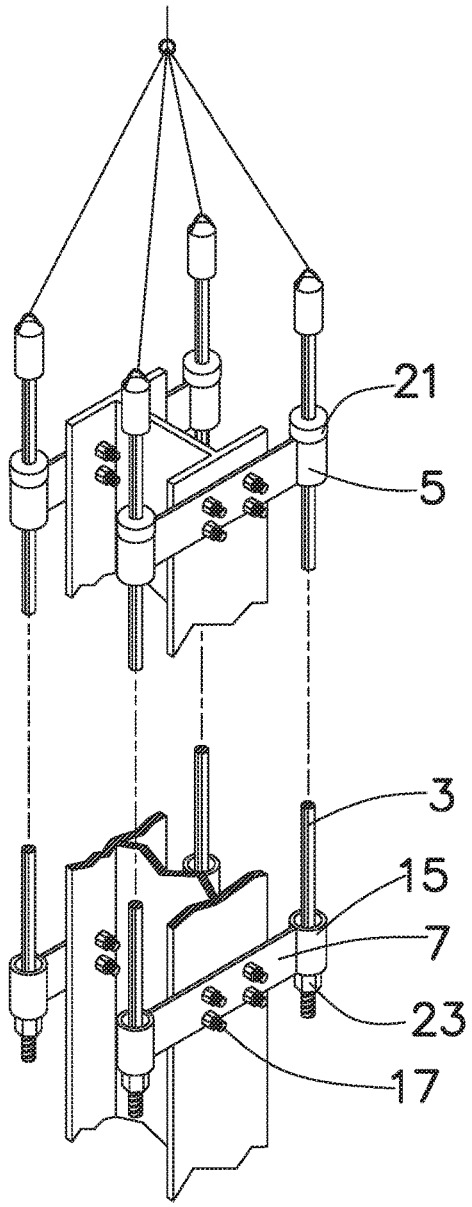
FIG. 4B is an isometric view of yet other embodiments of the upper and lower support pieces and lifting bars of the present invention
Figure 5:
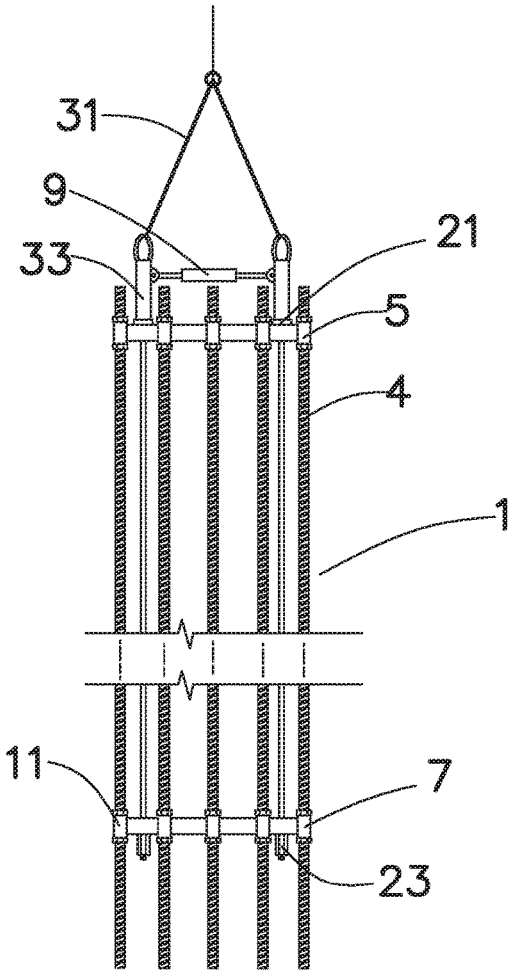
FIG. 5 is an elevational view of the elongated element of Bongiorno '287 adapted for the upper and lower support pieces and lifting bars of the present invention.
Figure 6:
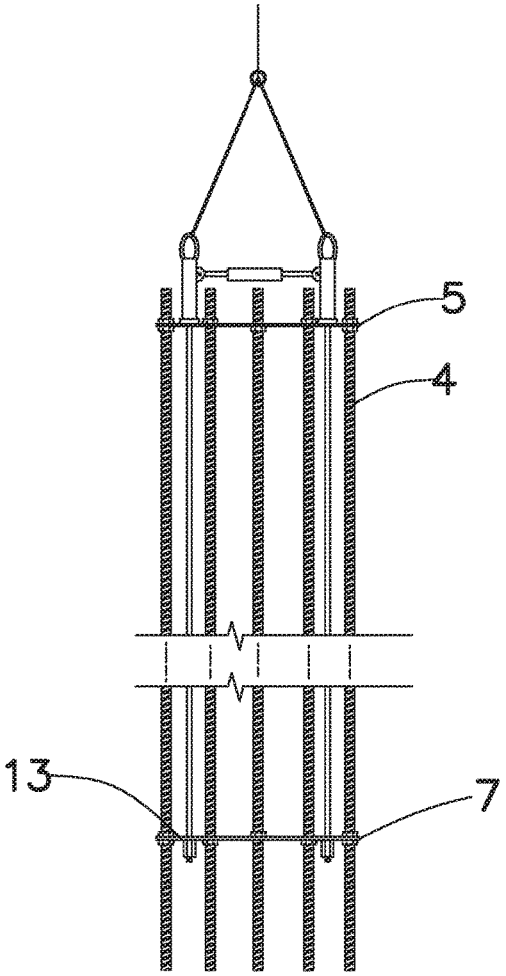
FIG. 6 is an elevational view of the elongated element of Ferrer '479 adapted for the upper and lower support pieces and lifting bars of the present invention.
Figure 9:
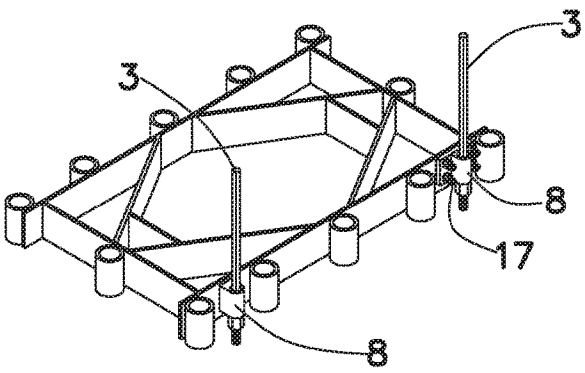
FIG. 9 is an isometric view of another embodiment of the cage frame of Bongiorno '287 adapted for use as the lower support piece and lifting bars of the present invention.
Figure 12:
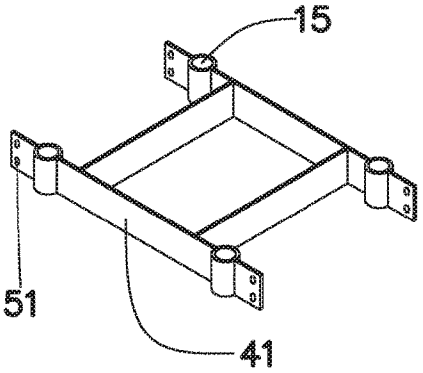
FIG. 12 is an isometric view of an independent stiffening frame of the present invention.
Figure 10:
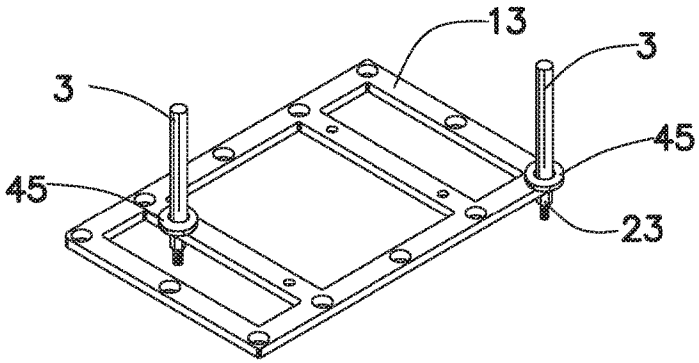
FIG. 10 is an isometric view of the template of Ferrer '479 adapted for use as the lower support piece and lifting bars of the present invention.
Figure 11:
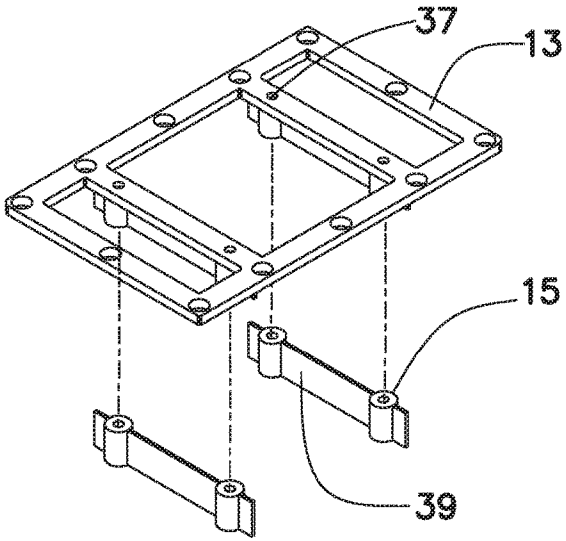
FIG. 11 is an isometric view of the template of Ferrer '479 supplemented with additional stiffening frames of the present invention.
Figure 13:
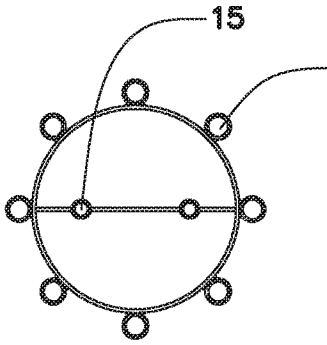
FIG. 13 is a plan view of the cage frame of Bongiorno '287 adapted for use as a support piece of the present invention.
Figure 14:
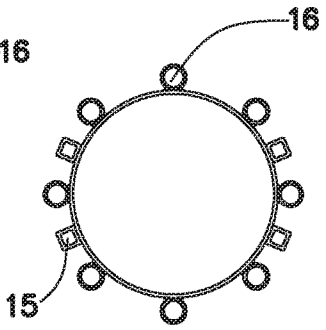
FIG. 14 is a plan view of another embodiment of the cage frame of Bongiorno '287 adapted for use as a support piece of the present invention.

Referring to FIGS. 4B & 12, a loadbearing frame (41) comprised preferably of one or more axially extending steel plates rigidly connected together preferably by welding is provided with at least one axially extending sleeve (15) to accept at least one lifting bar (3). Alternatively, at least one bracket (6) is attached to the frame plates by welding (19) or by fasteners (17). The at least one bracket (6) is preferably made of steel and is provided with an aperture (37) for receiving the lifting bar (3). Alternatively, additional frame plates can be added and arranged to form the aperture (37) similar to FIGS. 8 and 15. The loadbearing frame (41) is provided with holes (51) when the method of connection with the elongated element (1) is by fasteners (17)

Where the elongated element (1) is comprised of a framework, such as a lattice or trussed tower-like structure, the support pieces (5 & 7) of the present invention, acting as independent loadbearing frames (41), are preferably attached to the elongated element (1) with fasteners (17) or by welds (19).

Referring to FIGS. 3A-4B, where the elongated element (1) is comprised of a solid or continuous type element, such as a structural steel column, tubular structure or precast concrete column, the support pieces (5&7) of the present invention are preferably comprised of at least one bracket (6) attached to the element (1) by welding (19) or by fasteners (17). The at least one bracket (6) is preferably made of steel and is provided with an aperture (37) for receiving the lifting bar (3). Alternatively the support pieces (5&7) may be provided as independent loadbearing frames (41), preferably attached to the elongated element (1) with fasteners (17) or by welds (19). The upper and lower support pieces (5&7) in these embodiments, together with the lifting bars (3), achieve the objects of the present invention in the same way as other embodiments or the support pieces (5&7) described herein.

Referring to FIGS. 18-21, the at least one lifting bar (3) is comprised preferably of steel bars preferably with external threading (27) along at least a portion of its length to accept a loadbearing nut (23) having complimentary internal threading. The loadbearing nut (23) is preferably provided with a temporary holding means (35) comprised preferably of a spring clamp, but alternatively may be provided with a standard set screw (29).

The upper end of the lifting bar (3) is provided with a preferably steel lifting collar (33) preferably comprised of steel and preferably internally threaded complimentary to the threading (27) on the lifting bar (3), or in the case of an unthreaded lifting bar (3), preferably preferably attached to the lifting bar (3) by welding. A steel lifting ring, or hook eye, is preferably attached for rigging to the lifting lines (31). The at least one lifting bar (3) is further provided with a stop piece (21), preferably a nut (54) or plate attached to the lift bar (3), located above the upper support piece (5) to prevent undesired movement of the lifting bar (3) toward the lower support piece (5), while allowing for free movement of the lifting bar (3) in the longitudinal direction away from the lower support piece (7) during extraction of the lifting bar (3).

The lifting collar (33) is preferably located in close proximity to the top of the upper support piece (5) to reduce the projected length of the lifting bar (3) between the upper support piece (5) and the lifting collar (33), thus minimizing undesirable lateral and bending stresses in the lifting bar (3).

Where the aperture (7) for the at least one lifting bar (3) is larger than desired, the annular space between the lifting bar (3) and the aperture (37) can be reduced with the use of a bushing (45) or makeup collar (53) comprised preferably of a steel cylindrical sleeve.

Referring also to FIGS. 24A-25B for diagrammatic illustration, where more than on lifting bar (3) is used, they may be provided with a spreader piece, such as an adjustable spreader bar (9) oriented perpendicular to the longitudinal axis of the lifting bar (3), to resist the horizontal force (59) resulting for example from the lifting lines (31) acting at an angle to the longitudinal axis of the lifting bars (3). The spreader bar (9) thus minimizes undesirable lateral deflection (56) and bending stress (55) in the lifting bars (3) that would occur if the only lateral restraint (58) to resist such horizontal force were from the upper support piece (5) located at a vertical distance below the lifting collar (33). The spreader bar (9) also maintains lateral separation between the top portions of the lifting bars (3) during installation and after they have been extracted.

Figure 22A:
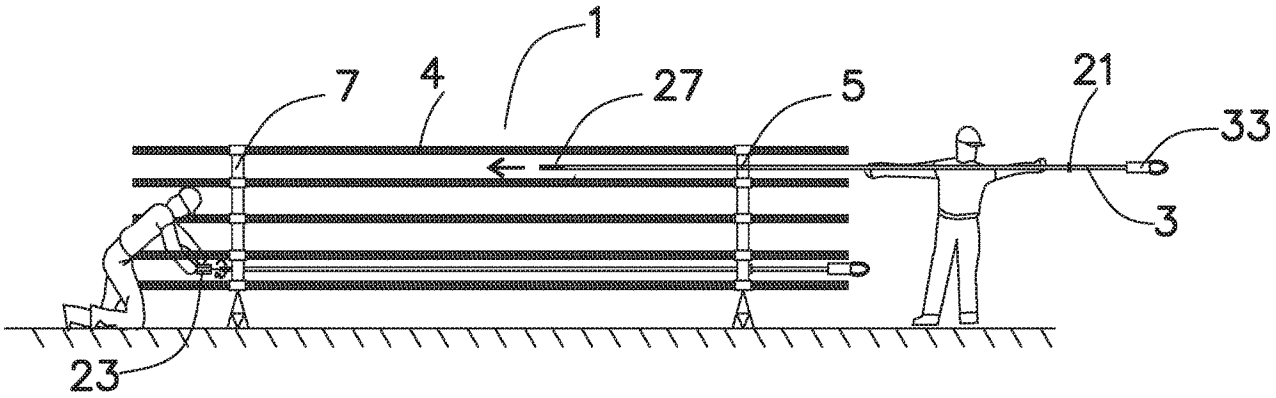
FIG. 22A is an elevation view of the installation of one embodiment of the lifting bar into one embodiment of the elongated element of the present invention.

Referring to FIG. 22A, the at least one lifting bar (3) is installed within or onto the elongated element (1) at any time prior to the erection of the element (1). This may be done in a shop or at the location where the erection of the element (1) is to be made by inserting the one or more lifting bars (3) through the respective apertures (37) in the at least two support pieces (5&7) to its intended position in the elongated element (1) until the at least one stop piece (21) bears against the upper support piece (5). At least one loadbearing nut (23) is installed onto the at least one lifting bar (3) until it bears against the lower support piece (7), The thus installed loadbearing nut (23) bearing against the lower support piece (7) and the stop piece (21) bearing against the upper support piece (5) ensures that at least one lift bar (3) is maintained in its intended position along the elongated element (1) until it is desired to remove said at least one lifting bar (3).

Figure 22B:
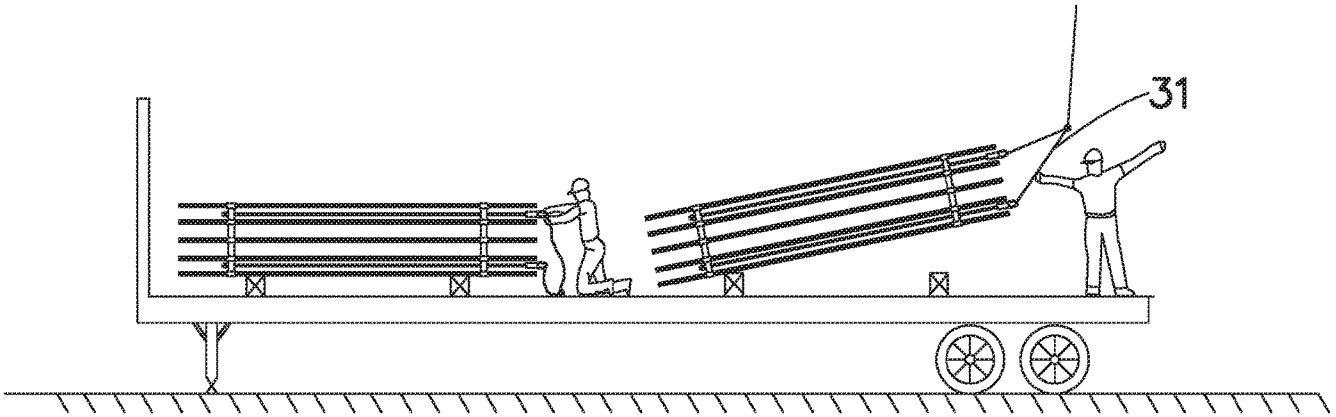
FIG. 22B is an elevation view of the initiation of the on-site erection sequence of the elongated element of the present invention.
Figure 23C:
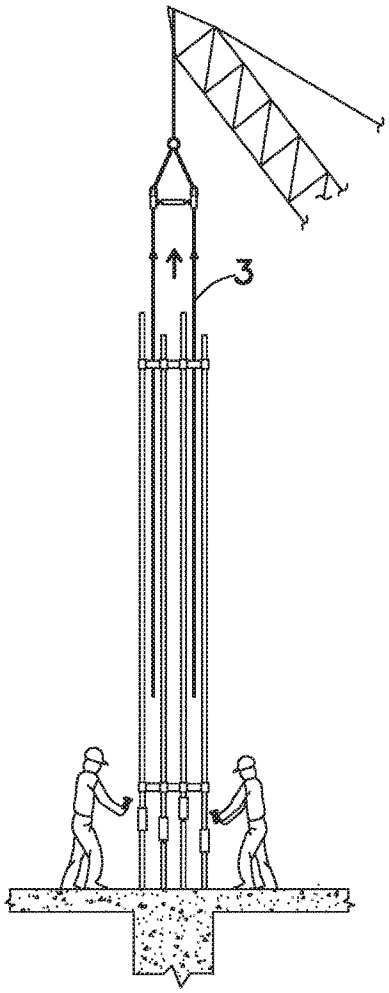
FIG. 23C is an elevation view of the continuation on-site erection sequence of one embodiment of the elongated element of the present invention with the lifting bars being removed
Figure 23B:
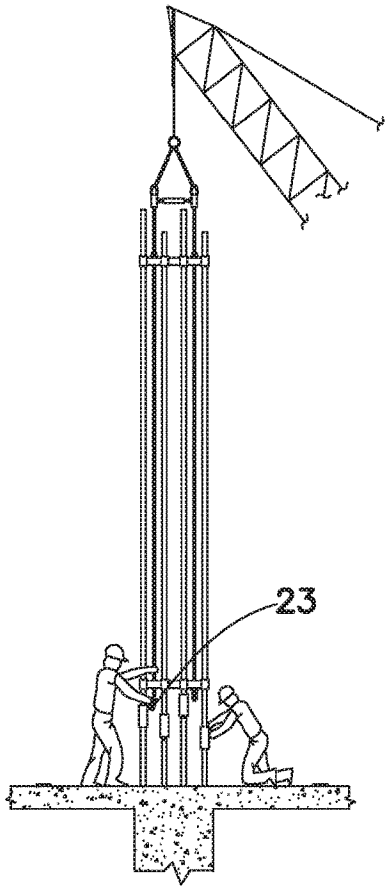
FIG. 23B is an elevation view of the continuation on-site erection sequence of one embodiment of the elongated element of the present invention with the loadbearing nuts being removed.
Figure 23A:
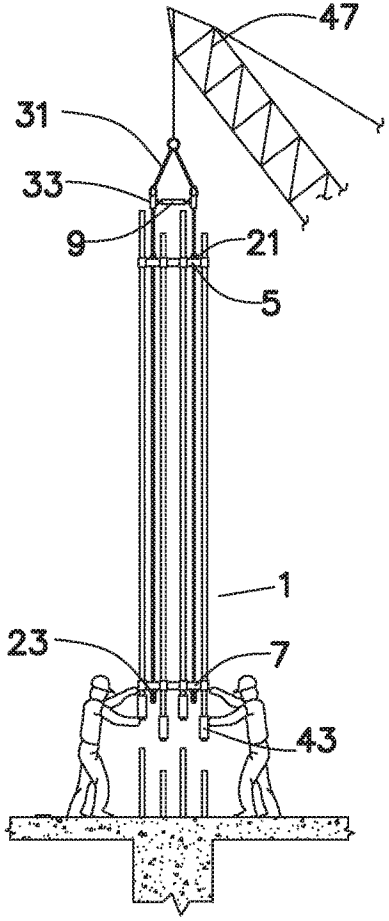
FIG. 23A is an elevation view of the on-site erection sequence of one embodiment of the elongated element of the present invention.
Figure 23F:
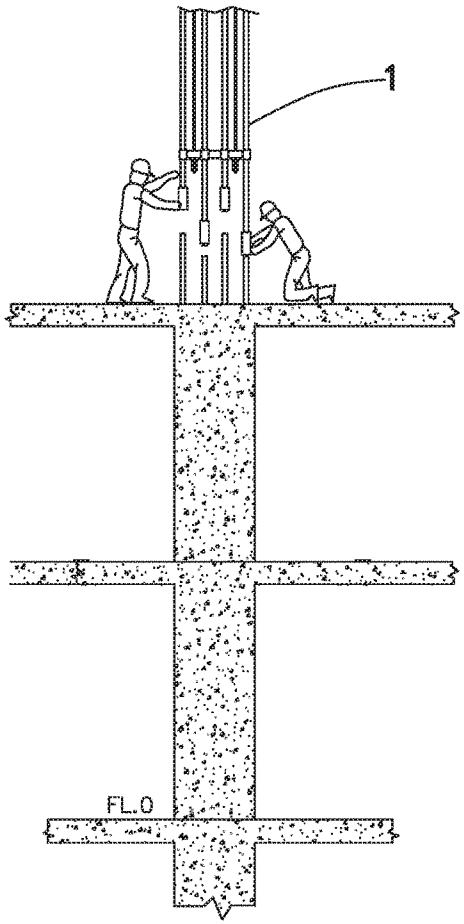
FIG. 23F is an elevation view of the continuation on-site erection sequence of a successive elongated element of the present invention.
Figure 23E:
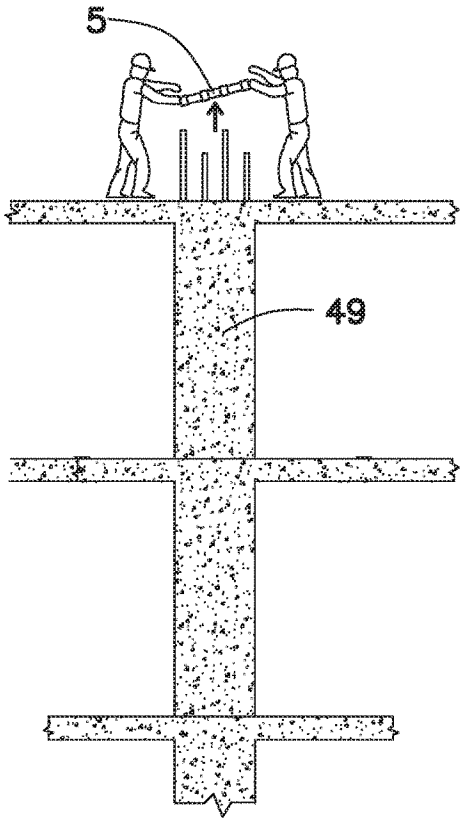
FIG. 23E is an elevation view of the continuation on-site erection sequence of the elongated element of the present invention with the upper support piece being optionally removed
Figure 23D:
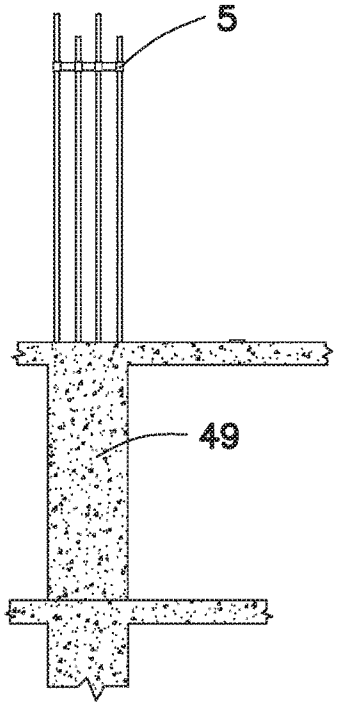
FIG. 23D is an elevation view of the continuation on-site erection sequence of one embodiment of the elongated element of the present invention where concrete is placed along a partial length of the element.
Figure 24A:
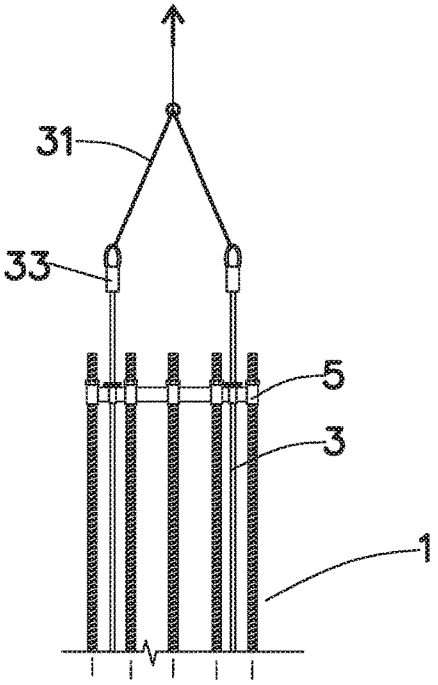
FIG. 24A is an elevation view of the upper portion of one embodiment of the elongated element of the present invention without spreader bars between the lifting bars.
Figure 24B:
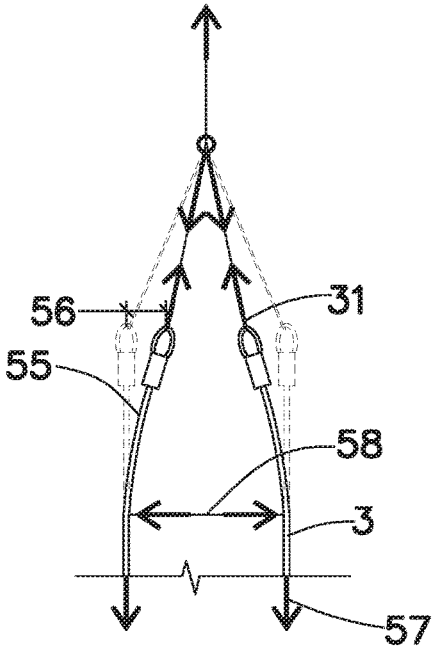
FIG. 24B is a diagrammatical view of the equilibrium of forces associated with FIG. 24A during lifting, and the resulting effects on the lifting bars.
Figure 25A:
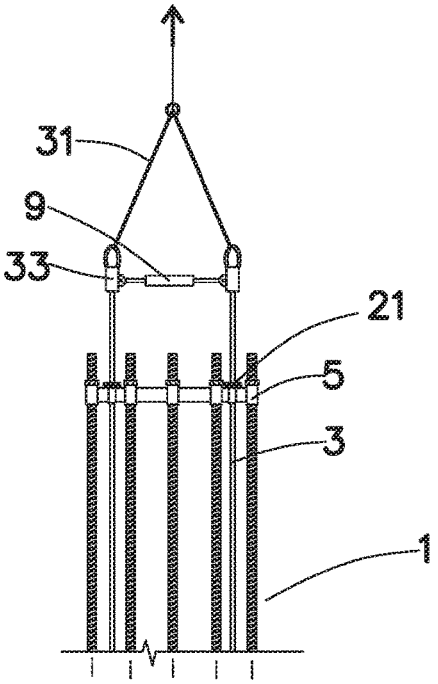
FIG. 25A is an elevation view of the upper portion of one embodiment of the elongated element of the present invention with spreader bars between the lifting bars.
Figure 25B:
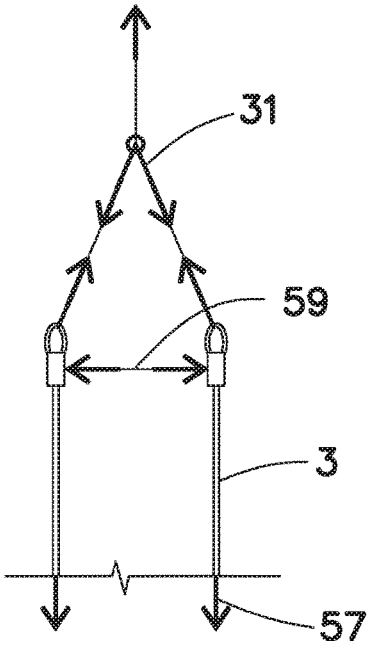
FIG. 25B is a diagrammatical view of the equilibrium of forces associated with FIG. 25A during lifting.
Figure 27B:
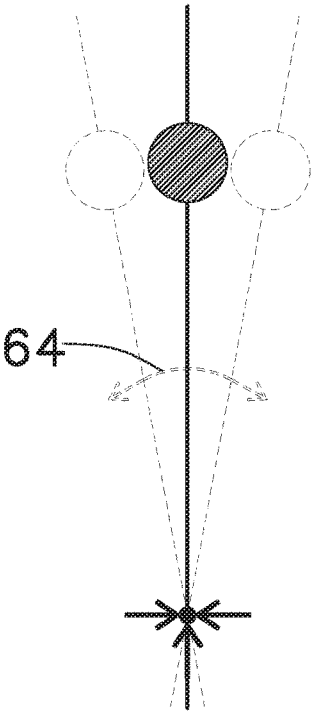
FIG. 27B is a diagrammatical view of the potential instability associated FIG. 27A
Figure 27A:
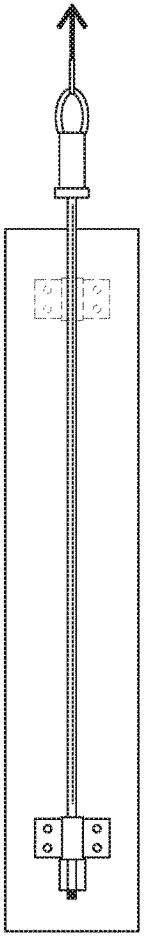
FIG. 27A is an elevation view of a representative elongated element of the present invention without lateral restraint from the upper support piece.
Figure 26B:
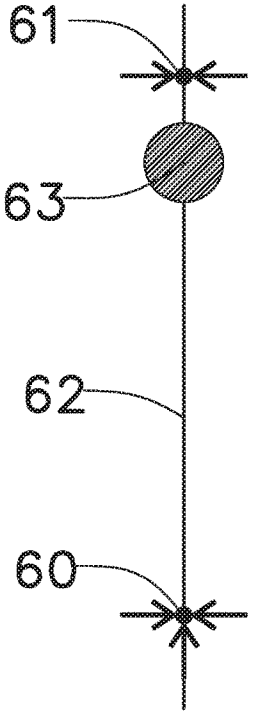
FIG. 26B is a diagrammatical view of the stability and equilibrium of forces associated FIG. 26A
Figure 26A:
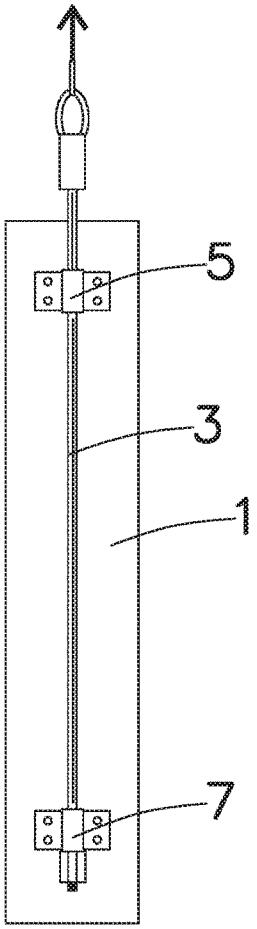
FIG. 26A is an elevation view of a representative elongated element of the present invention with lateral restraint from the upper support piece.

Referring to FIG. 22B, when the elongated element (1) is ready to be erected, a lifting device (47) is used with at least one lifting line (31) attached to the lifting collar (33) on the at least one lifting bar (3), and the element (1) is hoisted to its intended position.

Referring to FIGS. 23A-23F, once the thus prepared elongated element (1) is hoisted to its intended position or else sufficiently connected to another element (1), the loadbearing nut (23) on the at least one lifting bar (3) is removed and the at least one lifting bar (3) is extracted from elongated element (1) and can be reused for subsequent or future elements (1). One or both support pieces (5&7) can then be optionally removed.

Possible Modifications and Variations

The foregoing description of one or more embodiments of the present invention has been presented for the purposes of illustration and description. While the foregoing detailed description of the invention enables one of ordinary skill to make and use the invention, those skilled in the art will understand and appreciate the existence of variations, modifications, combinations and equivalents of the specific embodiments and methods presented. It is understood that changes in the specific embodiments and methods shown and described may be made within the scope of the description without departing from the spirit of the invention. For example, the elongated element of the present may be comprised of any material and assembly, such as for example mechanical units, foundation element, modular structural units, etc. . . . . As another example, the support pieces of the present invention may be constructed of any materially and configuration that is capable of supporting the loading of the elongated element. Additionally the more than two support pieces may be utilized, with additional support pieces located between the uppermost and lowermost support pieces.

I claim:

1. An erection system comprising:

a prefabricated element adapted for vertical installation in said erection system;

said element having upper and lower spaced support pieces;

at least one lifting bar extending through said element and said upper and lower support pieces, and having a lifting collar at an upper end thereof;

said at least one lifting bar providing lateral restraint to said element from respective support pieces bearing laterally against said at least one lifting bar at respective apertures therein for insertion of said at least one lifting bar;

an internally threaded piece below said lower support piece releasably connected to said at least one lifting bar bearing against said lower support piece for supporting the weight of said element while ensuring lateral restraint for stability and positioning of a lower portion of said element;

a stop piece on said at least one lifting bar in engagement with said upper support piece for preventing undesired movement of the said at least one lifting bar toward the lower support piece while allowing free movement of the said at least one lifting bar in a longitudinal direction during extraction of said at least one lifting bar after releasing of said internally threaded piece for withdrawal of said at least one lifting bar from said element after installation thereof; and, at least one lifting line extending outwardly from a rigging having a distal end attached to said lifting collar of said at least one lifting bar for raising and lowering thereof.

2. The erection system as in claim 1 wherein said at least one lifting bar comprises a plurality of spaced apart lifting bars.

3. The erection system as in claim 2 further comprising said erection system having a spreader to resist horizontal reaction to said plurality of spaced apart lifting bars, whereby said spreader thereby minimizes lateral and bending stress in said plurality of lifting bars and maintains lateral separation between said top ends of said plurality of lifting bars, during installation and extraction of said plurality of lifting bars.

4. The erection system of claim 1 in which said prefabricated element is selected from the group consisting of a reinforcement cage, steel column, precast concrete column, lattice work and tower section.

5. The erection system of claim 4 in which said prefabricated element is a reinforcement cage comprising:

a plurality of extending, spaced and parallel reinforcing bars;

each of said support pieces comprising a framework of vertically oriented plates with sleeves mounted thereon to accommodate said reinforcing bars passing therethrough; and separate spaced sleeves or apertures for accommodating said at least one lifting bar.

6. The erection system of claim 4 in which said prefabricated element is a reinforcement cage comprising:

a plurality of extending, spaced and parallel reinforcing bars;

each of said support pieces comprising a template with openings to accommodate said reinforcing bars; and openings to accommodate said at least one lifting bar.

7. The erection system as in claim 6 wherein said openings further comprise bushings to accommodate said at least one lifting bar.

8. The erection system of claim 1 in which said said internally threaded piece comprises a removable loadbearing nut threaded onto said at least one lifting bar at an underside of the lower support piece to facilitate installation and removal, and also to permit vertical adjustment of the elevation of a support point of the said at least one lifting bar against the lower support piece.

9. The erection system of claim 8 in which each said support piece is selected from the group consisting of a frame, bracket, and templates.

10. An erection system comprising:

a elongated steel or precast fabricated column adapted for vertical installation in said erection system;

said column having at least two, spaced outer surfaces;

upper and lower spaced support pieces mounted on said spaced outer surfaces;

a plurality of spaced apart lifting bars extending through said support pieces, respectively;

said plurality of lifting bars providing lateral restraint to said element from respective support pieces bearing laterally against said plurality of lifting bars at respective apertures therein for insertion of said lifting bars;

an internally threaded piece in said lower support pieces for attachment to said lifting bars for supporting the weight of said column while insuring lateral restraint of a lower portion of said column for stability during positioning of said column; and a stop piece on each said lifting bar in engagement with said upper support piece, for preventing undesired movement of the lifting bar toward the lower support piece while allowing free movement of the lifting bar in a longitudinal direction during extraction of said lifting bar, after releasing of said internally threaded piece and to ensure lateral stability of an upper portion of said column;

a plurality of lifting lines extending outwardly from a rigging having distal ends attached to a top end of said lifting bars for raising and lowering thereof.

11. The erection system as in claim 10 wherein a spreader is provided to resist horizontal reaction to said plurality of spaced apart lifting bars, whereby said spreader thereby minimizes lateral and bending stress in said spaced apart lifting bars and maintains lateral separation between said top ends of said lifting bars during installation and extraction of said lifting bars.

12. The erection system of claim 10 in which said internally threaded piece comprises a removable loadbearing nut threaded onto each of said lifting bars at an underside of a lower support piece bracket mounted on each of said outer surfaces of said column to facilitate installation and removal, and also to permit vertical adjustment of the elevation of a support point of each said lifting bar against the lower support piece bracket.

13. The erection system of claim 12 in which each said bracket has mounted thereon a sleeve enclosing said lifting bar for engaging said loadbearing nut.

14. The erection system of claim 13 in which each bracket has a flat portion mounted on said outer surface and extending past outer edges of said column, and a sleeve mounted on each of two distal ends of said bracket, whereby a total of four lifting bars are accommodated.

15. A method of assembling and installing a prefabricated construction comprising the steps of:

providing a prefabricated element adapted for vertical installation in an erection system;

providing said element with upper and lower spaced support pieces;

inserting at least one lifting bar through said element;

said at least one lifting bar providing lateral restraint to said element from respective support pieces bearing laterally against said at least one lifting bar at respective apertures therein for insertion of said at least one lifting bar;

releasably mounting on a lower end of said at least one lifting bar internally threaded piece bearing against said lower support piece for supporting the weight of said element while insuring lateral restraint for stability and positioning of a lower portion of said element;

providing a stop piece on said at least one said lifting bar for engagement with said upper support piece for preventing undesired movement of the said at least one lifting bar toward the lower support piece while allowing free movement of the said at least one lifting bar in a longitudinal direction during extraction of said at least one lifting bar after releasing of said internally threaded piece and to ensure lateral stability of an upper portion of said element;

providing at least one lifting line extending outwardly from a rigging having a distal end attached to a top end of said at least one lifting bar for raising and lowering thereof.

16. The method of assembling a prefabricated construction as in claim 15 wherein said at least one lifting bar is a plurality of lifting bars.

17. The method of assembling a prefabricated construction as in claim 16 further comprising the step of providing a spreader to resist horizontal reaction to said lifting bars thereby minimizing lateral and bending stress in said lifting bars and to maintain lateral separation between said top ends of said lifting bars during installation and extraction of said lifting bars.

18. The method of claim 15 in which said prefabricated element is selected from the group consisting of a reinforcement cage, steel column, precast concrete column, lattice work and tower section.

19. The method of claim 18 in which said attachment comprises a removable loadbearing nut threaded onto said at least one lifting bar at an underside of the lower support piece to facilitate installation and removal, and also to permit vertical adjustment of the elevation of a support point of the said at least one lifting bar against the lower support piece.

20. The method of claim 19 in which each said support piece is selected from the group consisting of a frame, bracket, and templates.

21. The method of claim 18 in which said prefabricated element is a reinforcement cage comprising:

a plurality of extending, spaced and parallel reinforcing bars;

each of said support pieces comprising a framework of vertically oriented plates with sleeves mounted thereon to accommodate said reinforcing bars passing therethrough; and separate spaced sleeves or apertures for accommodating said at least one lifting bar.

22. The method of claim 18 in which said prefabricated element is a reinforcement cage comprising:

a plurality of extending, spaced and parallel reinforcing bars;

each of said support pieces comprising a template with openings to accommodate said reinforcing bars; and openings to accommodate said at least one lifting bar.

23. The method as in claim 22 wherein said openings further comprise bushings to accommodate said at least one lifting bar.

24. A method of assembling a prefabricated construction comprising the steps of:

providing an elongated steel or precast fabricated column adapted for vertical installation in an erection system;

said column having at least two, spaced outer surfaces;

mounting upper and lower spaced support pieces on said spaced outer surfaces;

extending a plurality of spaced apart lifting bars through said support pieces, respectively;

said plurality of lifting bars providing lateral restraint to said element from respective support pieces bearing laterally against said plurality of lifting bars at respective apertures therein for insertion of said lifting bars;

providing an internally threaded piece in said lower support pieces for attachment to said lifting bars for supporting the weight of said column while insuring lateral restraint of a lower portion of said column for stability during positioning of said column; and providing a stop piece on each of said lifting bars for engagement with said upper support piece for preventing undesired movement of the lifting bar toward the lower support piece while allowing free movement of the lifting bar in a longitudinal direction during extraction of said lifting bar after releasing of said internally threaded piece and to ensure lateral stability of an upper portion of said column; and, using a plurality of lifting lines extending outwardly from a rigging having distal ends attached to a top end of said lifting bars for raising and lowering thereof.

25. The method of assembling of claim 24 a prefabricated construction further comprising the step of providing a spreader to resist horizontal reaction to said plurality of space apart lifting bars, whereby said spreader minimizes lateral and bending stress in said lifting bars and to maintain lateral separation between said top ends of said lifting bars during installation and extraction of said lifting bars.

26. The erection system of claim 25 in which said internally threaded piece comprises a removable loadbearing nut threaded onto each of said lifting bars at an underside of a lower support piece bracket mounted on each of said outer surfaces of said column to facilitate installation and removal, and also to permit vertical adjustment of the elevation of a support point of each said lifting bar against the lower support piece bracket.

27. The method of claim 26 in which each said bracket has mounted thereon a sleeve enclosing said lifting bar for engaging said loadbearing nut.

28. The method of claim 27 in which each bracket has a flat portion mounted on said outer surface and extending past outer edges of said column, and a sleeve mounted on each of two distal ends of each said bracket, whereby a total of four lifting bars are accommodated.

* * * * *